US006052091A

United States Patent [19]

Lee

[11] Patent Number: 6,052,091

[45] Date of Patent: Apr. 18, 2000

[54] MULTIPLE LOOP ANTENNA OF RADIO PAGING RECEIVER

[75] Inventor: Seok-Jun Lee, Kumi, Rep. of Korea

[73] Assignee: Samsung Electronics Co., Ltd., Rep. of Korea

[21] Appl. No.: 09/143,020

[22] Filed: Aug. 28, 1998

[30] Foreign Application Priority Data

Aug. 28, 1997 [KR] Rep. of Korea ..... 97-41890

[51] Int. Cl.[7] ..... H01Q 11/12

[52] U.S. Cl. ..... 343/742; 343/867

[58] Field of Search ..... 343/702, 741, 343/742, 728, 726, 748, 764, 855, 866, 867; H01Q 3/24, 11/12

[56] References Cited

U.S. PATENT DOCUMENTS 4,595,928 6/1986 Wingard ..... 343/742

4,804,965 2/1989 Roederer ..... 343/700 MS 5,258,766 11/1993 Murdoch ..... 343/742

5,592,182 1/1997 Yao et al. ..... 343/742

5,784,032 7/1998 Johnston et al. ..... 343/702

*Primary Examiner*—Don Wong

*Assistant Examiner*—Tho Phan

*Attorney, Agent, or Firm*—Dilworth & Barrese

[57] ABSTRACT

A multiple loop antenna of a radio paging receiver comprising a first loop antenna, and a second loop antenna electrically connected to the first loop antenna, wherein the second loop antenna is positioned with respect to the first loop antenna to receive a radio wave travelling in a direction in which the receiving sensitivity of the first loop antenna is lowered.

4 Claims, 4 Drawing Sheets

MULTIPLE LOOP ANTENNA OF RADIO PAGING RECEIVER

BACKGROUND

1. Technical Field

The present application relates generally to an antenna for receiving radio signals in a radio paging receiver and, more particularly, to a multiple loop antenna for use in a radio paging receiver.

2. Description of the Related Art

In accordance with the continued goal of designing smaller and lighter products, manufactures of conventional radio paging receivers have widely utilized loop antennas in their radio paging receivers due to their small size and light weight. Referring to FIG. 1, an exploded view of a radio paging receiver having a conventional loop antenna is shown. In general, the radio paging receiver includes a case 1, a radio frequency (RF) board 2, and a loop antenna 3.

Referring to FIGS. 2A and 2B, the relationship between an electric field E and a magnetic field M and the position of the conventional loop antenna 3 with respect to the direction of travel of a radio signal is shown. The loop antenna 3 is a directional antenna which exhibits a different receiving sensitivity based on its position with respect to the direction of travel of the electromagnetic radio wave. In particular, the single loop antenna 3 used in the radio paging receiver exhibits maximum receiving sensitivity when reacting to the magnetic field component of the radio signal, whereas the single loop antenna 3 exhibits significantly lowered sensitivity when reacting to the electric field component of the radio signal. For instance, the loop antenna 3 exhibits maximum receiving sensitivity when the loop antenna is positioned as indicated in FIG. 2A with respect to the given direction of travel of the radio wave since the loop antenna significantly reacts to the magnetic field component M of the radio wave. On the other hand, the loop antenna 3 exhibits minimum receiving sensitivity when it is positioned as shown in FIG. 2B since it reacts to the electric field component E (as opposed to the magnetic field component M) of the radio wave.

SUMMARY OF THE INVENTION

The present application is directed to a multiple loop antenna for a radio paging receiver which exhibits significant receiving sensitivity regardless of the position of the multiple loop antenna with respect to the direction of travel of an electromagnetic radio wave. In one aspect, a multiple loop antenna of a radio paging receiver comprises a first loop antenna, and a second loop antenna electrically connected to the first loop antenna, wherein the second loop antenna is positioned with respect to said first loop antenna to receive a radio wave travelling in a direction in which the receiving sensitivity of the first loop antenna is lowered.

These and other objects, features and advantages of the present invention will become apparent from the following detailed description of illustrative embodiments, which is to be read in connection with the accompanying drawings.

DETAILED DESCRIPTION OF PREFERRED EMBODIMENTS

Figure 1:
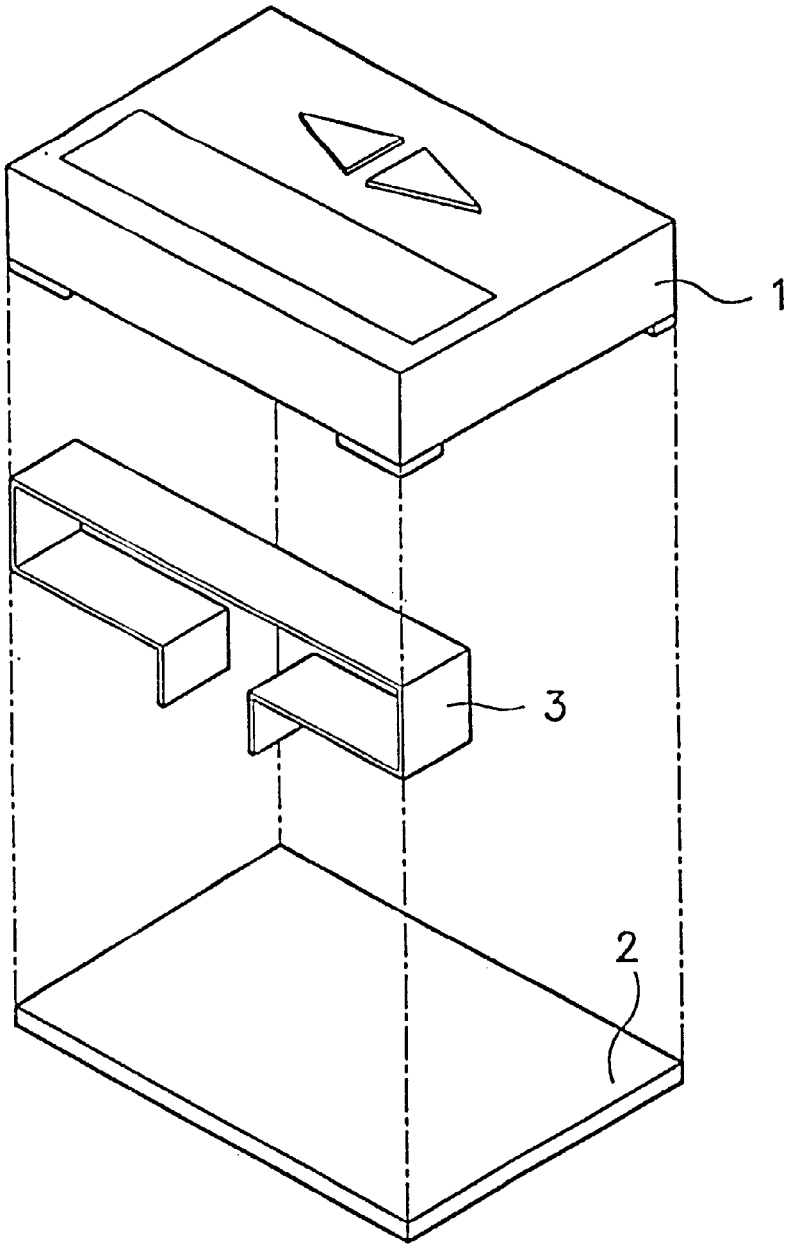
FIG. 1 PRIOR ART
FIG. 1 is an exploded view of a radio paging receiver having a conventional loop antenna.
Figure 2A:
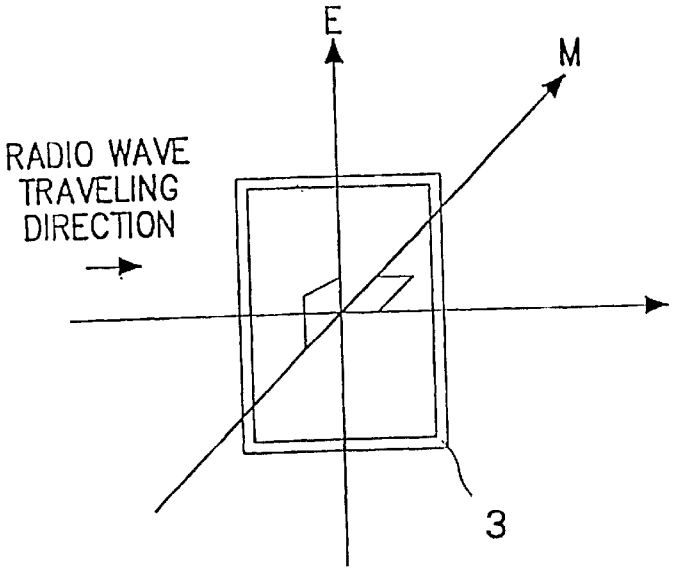
FIG. 2A PRIOR ART
FIGS. 2A and 2B illustrate the relationship between an electric field and a magnetic field of a radio wave and the position of the conventional loop antenna shown in FIG. 1 with respect to the direction of travel of the radio wave.
Figure 2B:
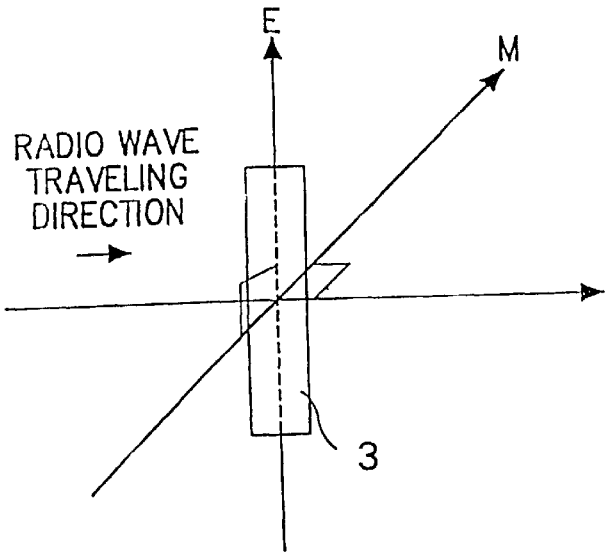
FIG. 2B PRIOR ART
Figure 3:
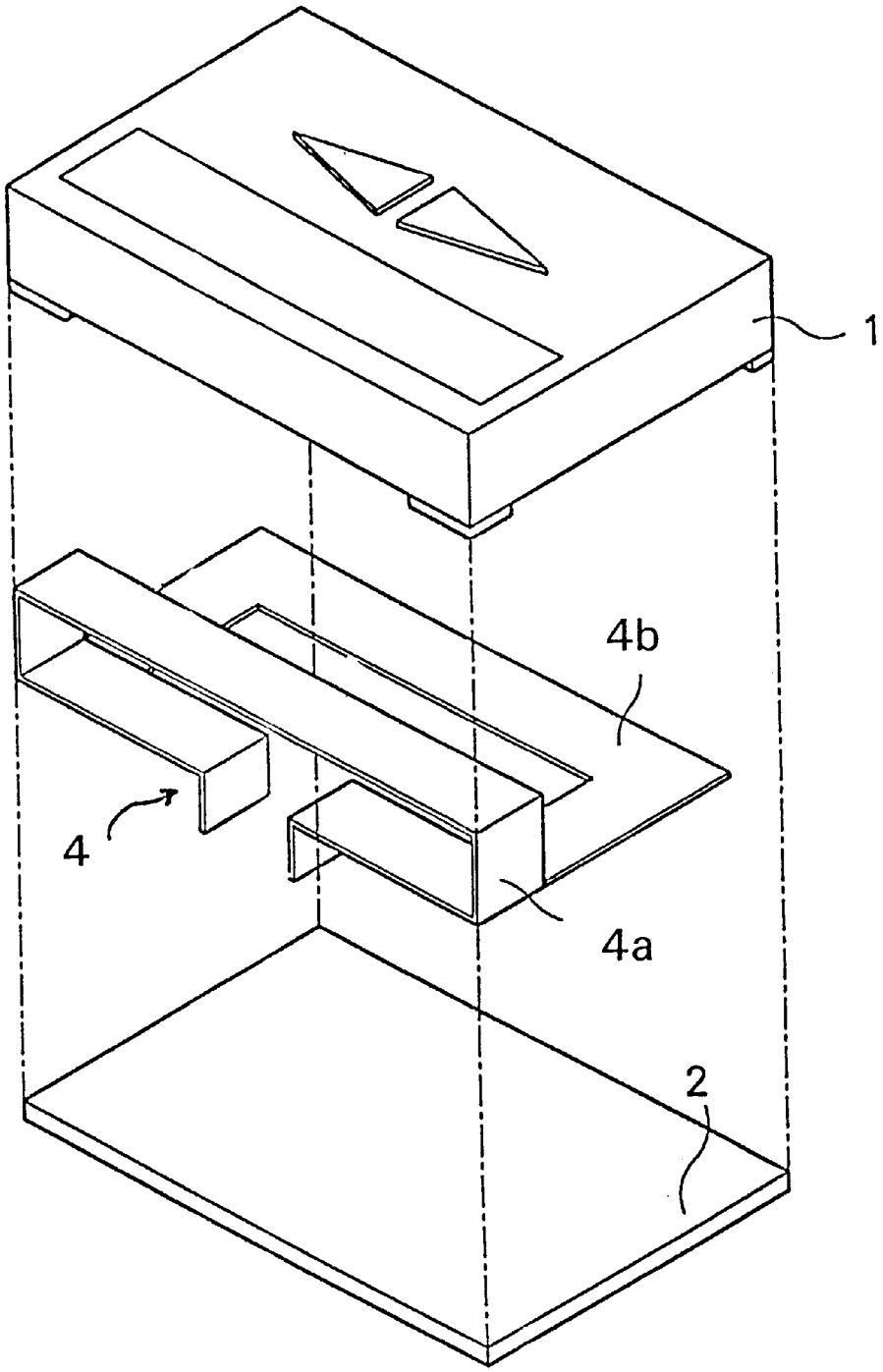
FIG. 3 is an exploded view of a radio paging receiver having a multiple loop antenna according to an embodiment of the present invention.

Referring now to FIG. 3, an exploded view of a radio paging receiver having a multiple loop antenna according to an embodiment of the present invention is shown. The multiple loop antenna 4 includes a first loop antenna 4*a* (which is similar to the conventional loop antenna 3 shown in FIG. 1) and a second loop antenna 4*b* electrically connected to the first loop antenna 4*a*. The first and second loop antennas 4*a* and 4*b* are positioned with respect to each other so as to increase the overall receiving sensitivity of the multiple loop antenna 4 regardless of the direction of travel of the electromagnetic radio wave coupled thereto. For example, since the magnetic field and electric field components of a radio wave are orthogonal, the second loop antenna 4*b* can be connected to the first loop antenna 4*a* at an angle of 90°. It is to be appreciated that the first loop antenna 4*a* and the second loop antenna 4*b* can be positioned with respect to each other at an angle of substantially 90°. It is to be further appreciated that the second loop antenna 4*b* may be connected to either the bottom portion of the first loop antenna 4*a* (as illustrated in FIG. 3) or the top portion of the first loop antenna 4*a*.

Figure 4A:
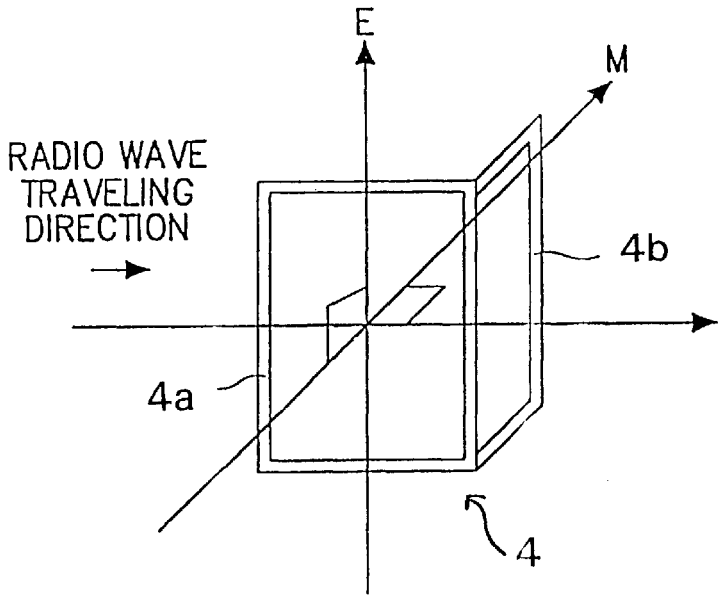
FIGS. 4A and 4B illustrate the relationship between an electric field and a magnetic field of a radio wave and the position of the multiple loop antenna shown in FIG. 3 with respect to the direction of travel of the radio wave.
Figure 4B:
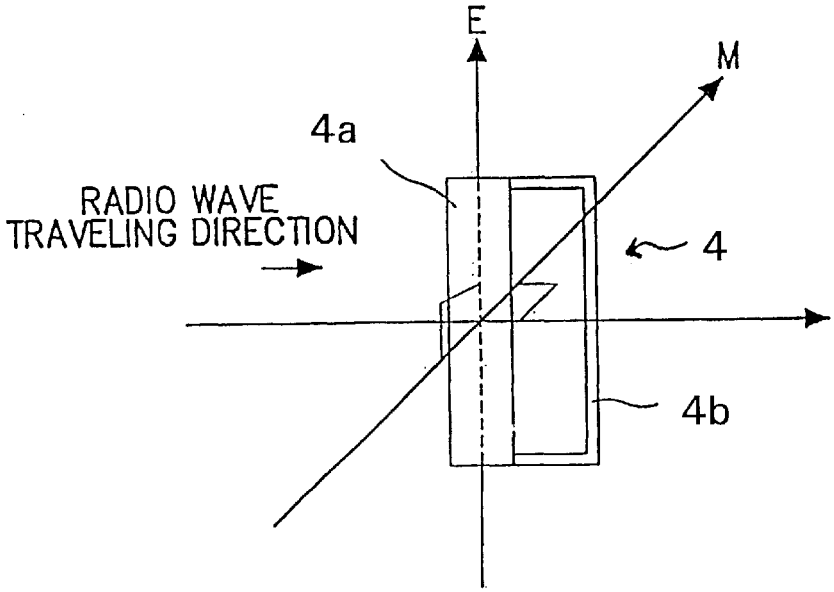

Referring now to FIGS. 4A and 4B, the relationship between an electric field E and a magnetic field M of an electromagnetic radio wave and the position of the multiple loop antenna 4 shown in FIG. 3 with respect to the direction of travel of the radio wave is shown. As mentioned above, single loop antennas are directional antennas. Referring to FIG. 4A, the first loop antenna 4*a* reacts to the magnetic field M, whereas, in FIG. 4B, the second loop antenna 4*b* reacts to the magnetic field M. Consequently, the multiple loop antenna 4 of the present invention exhibits improved receiving sensitivity (as compared with the conventional single loop antenna 3) since the receiving sensitivity of the multiple loop antenna 4 is not dependent on the direction of travel of the radio wave. For example, experiments have shown that the multiple loop antenna 4 exhibits an increased receiving sensitivity of approximately 3 decibels over the conventional single loop antenna 3 when reacting to the electric field.

In summary, the multiple loop antenna 4 according to the present invention is structured such that either the first loop antenna 4*a* or the second loop antenna 4*b* exhibits significant receiving sensitivity for a given direction of travel of a radio wave. In particular, as the receiving sensitivity of the first loop antenna 4*a* is lowered, the receiving sensitivity of the second loop antenna 4*b* increases (and vice versa). Therefore, since the first and second loop antennas 4*a* and 4*b* complement each other, the overall receiving sensitivity is improved.

Although the illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A multiple loop antenna of a radio paging receiver, comprising:

a first loop antenna; and a second loop antenna electrically connected directly to said first loop antenna, wherein said second loop antenna is positioned at an angle of about 90° with respect to said first loop antenna to receive a radio wave travelling in a direction in which the receiving sensitivity of the first loop antenna is lowered.

2. The multiple loop antenna of claim 1, wherein said second loop antenna is positioned at an angle of 90° with respect to said first loop antenna.

3. A multiple loop antenna of a radio paging receiver, comprising:

a first loop antenna; and a second loop antenna, electrically connected directly to said first loop antenna, said second loop antenna being positioned at an angle of about 90° with respect to said first loop antenna to react to a magnetic field when said first loop antenna does not react to the magnetic field.

4. The multiple loop antenna of claim 3, wherein said second loop antenna is positioned at an angle of 90° with respect to said first loop antenna.

* * * * *